United States Patent [19]

Pehr

[11] 4,190,169

[45] Feb. 26, 1980

[54] TAMPERPROOF PACKAGE

[76] Inventor: Harold T. Pehr, 3920 W. 96th St., Overland Park, Kans. 66207

[21] Appl. No.: 3,499

[22] Filed: Jan. 15, 1979

[51] Int. Cl.[2] ..... B65D 41/34

[52] U.S. Cl. ..... 215/252

[58] Field of Search ..... 215/252, 216, 221, 330, 215/318

[56] References Cited

U.S. PATENT DOCUMENTS

| | | | |
|---|---|---|---|
| 2,698,108 | 12/1954 | Schwartz . | |
| 2,768,762 | 10/1956 | Guinet . | |
| 3,231,123 | 1/1966 | Heierle . | |
| 3,399,796 | 9/1968 | Steiner | 215/216 |
| 3,484,012 | 12/1969 | White et al. | |
| 3,673,761 | 7/1972 | Leitz . | |
| 3,737,064 | 6/1973 | Patel et al. | 215/252 |
| 3,805,987 | 4/1974 | Horvath | 215/252 |
| 3,924,769 | 12/1975 | Fillmore . | |
| 4,055,266 | 10/1977 | Amabili . | |

*Primary Examiner*—Donald F. Norton

*Attorney, Agent, or Firm*—Fishburn, Gold & Litman

[57] ABSTRACT

A tamperproof package comprising a container sealed by means of a turn-off type cap wherein the container has a circumferential sealing finish with a sealing rim at the upper end of the circumferential finish and including cam surfaces with a locking shoulder therebelow on the circumferential ceiling finish. The closure cap includes a top wall with a peripheral skirt depending therefrom and having internal camming surfaces for mating engagement with the cam surfaces on the circumferential finish of the container. One or more locking lugs or detents are flexibly connected to the skirt for flexing in radial planes toward and away from the axis of the container with the locking lugs or detents and adjacent edges of the skirt having interlocking tongues and sockets to retain the locking lugs or detents engaged with the locking shoulder of the container. When the cap is turned for removal the cam surfaces urge the cap upwardly with the engagement of the locking detents with the shoulder providing a camming action that forces the detents radially outwardly, breaking or damaging the tongues and visually indicating the breaking of the seal. The locking detents and all portions of the closure cap remain as a removable unit for reuse or disposal with no separable portions remaining on the container or otherwise requiring disposal.

11 Claims, 6 Drawing Figures

TAMPERPROOF PACKAGE

The present invention relates to tamperproof packages and more particularly to such packages wherein the container is sealed by means of a turn-off type cap with structure to visually indicate the breaking of the seal.

In the field of packaging, many products are in sealed containers which are sealed by means of turn-off type closure caps. In order to assure a purchaser that the package has not been priorly opened, tamperproof closures have been developed wherein portions of the closure cap are connected to a skirt or the like thereof by means of weakened or frangible portions or bridges and such locking portions engaged with locking shoulders of the container in the manner that when the cap is turned for opening the bridges break or rupture, separating the locking portions from the remainder of the cap and permitting the remainder of the cap to be removed from the container. While such separable portions or rings provide a visual indication of prior opening of the container they also remain on the container and are difficult to remove for recycling and the use of the container in repackaging of goods therein. In packages having locking tabs or the like that are separable the recovery of the separable portions for proper disposal may be time consuming and difficult.

The principal objects of the present invention are to provide a tamperproof package with a container sealed by means of a turn-off type cap that overcome the aforementioned difficulties; to provide such a tamperproof package in which the container has a circumferential finish with inclined cam surfaces and a locking shoulder and the closure cap has a top wall and depending skirt with inclined camming surfaces for mating with cam surfaces on the circumferential finish with locking lugs flexibly connected to the skirt and engaged with the locking shoulder with the interlocking means between the lugs and the skirt to secure said locking lugs which locking lugs are forced radially outwardly when the cap is turned for removal, the lugs remaining connected to the cap and providing visual indication of the breaking of the seal; to provide such a structure wherein the closure cap is for use with a container having an externally threaded neck and locking shoulder and the closure cap comprises a top and peripheral skirt depending therefrom with internal threads on the skirt for mating engagement with the threaded neck of the container and the locking lugs are flexibly connected to the skirt to flex in radial planes toward and away from an axis concentric with and perpendicular to the top wall; to provide such a structure wherein the closure cap is molded of plastic material and the top wall skirt and locking lugs are all integrally connected parts of the unitary structure; to provide such a structure wherein the cap skirt has one or more circumferentially spaced slots with the locking lugs being located therein and the side edges of the locking lug and sides of the slot having cooperating fastener means for interlocking engagement with each other instant to radial inward movement of the locking lugs to secure said locking lugs; to provide such a structure wherein turning movement of the closure cap causes the inclined camming surfaces or threads to urge the cap upwardly and the locking shoulder cams the locking lugs radially outwardly to provide a visual indication of the breaking of the seal; to provide such a structure wherein the locking lugs remain connected to the skirt of the closure cap during removal and permitting the closure cap to be replaced on the container to reseal same if the contents are not completely used; to provide such a tamperproof package wherein all of the closure cap remains as a unitary structure when removed, leaving no portion thereof on the container; to provide such a tamperproof package that is economical to manufacture, convenient to use and well adapted for the purposes intended.

Other objects and advantages of this invention will become apparent from the following description taken in connection with the accompanying drawings wherein are set forth by way of illustration and example certain embodiments of this invention.

The drawings constitute part of the specification and include exemplary embodiments of the present invention and illustrate various objects and features of the tamperproof package.

Figure 1:
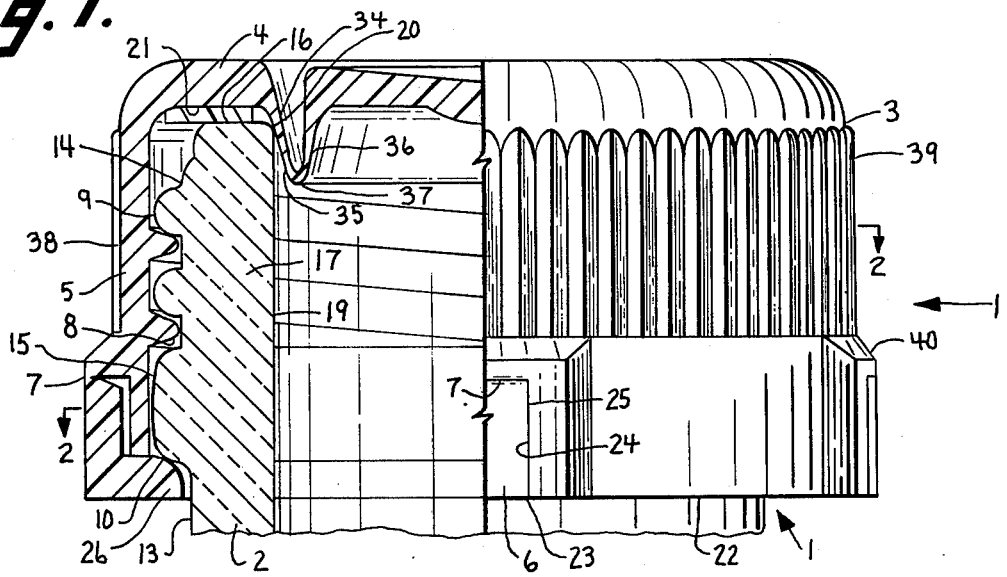
FIG. 1 is a side elevational view, partially in cross-section of the closure cap in position on a container finish with the locking feature in position to prevent removal of the closure cap.
Figure 2:
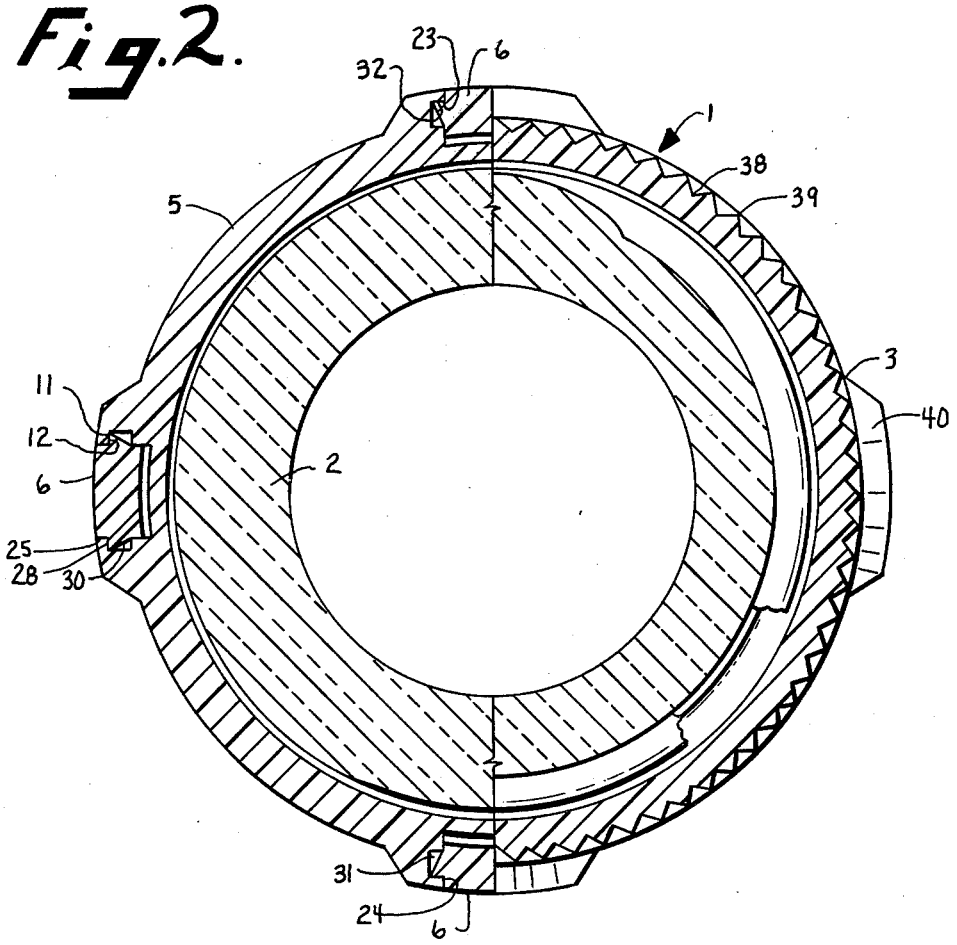
FIG. 2 is a transverse sectional view through the closure cap and container taken on the line 2—2, FIG. 1.

Referring more in detail to the drawings:

As required, detailed embodiments of the present invention are disclosed herewith, however, it is to be understood that the disclosed embodiments are merely exemplary of the invention which may be embodied in various forms. Therefore, specific structural and functional details disclosed herein are not to be interpreted as limiting but merely as a basis for the claims and a representative basis for teaching one skilled in the art to variously employ the present invention in virtually any appropriately detailed structure.

The reference numeral 1 generally designates a tamperproof package which includes a container 2 with a closure or cap 3. The cap is preferably formed of synthetic resin suitable for use in packaging of foods. In the structure illustrated the closure or cap is a one-piece integral structure with a top wall 4, depending skirt 5 and one or more detents 6 connected to skirt portions by integral hinges 7. The closure or cap fits on a container portion and the closure has cam surfaces 8 cooperating with cam surfaces 9 on the container to mount the closure thereon. The detents 6 are moved to engage under a shoulder 10 on the container with interengaging portions 11 and 12 on the detents and closure skirt respectively to retain the engagement until the cap 3 is rotated for removal with such removal urging the cap upwardly and forcing the detents 6 radially outwardly, breaking and damaging the interconnecting portions with the outwardly extending detents giving a visual indication that the cap has been at least partially removed.

In the illustrated form of the invention the container 2 is illustrated as having a necked in portion 13 defining a neck of the container located directly below the container sealing finish portion 14. The sealing finish portion 14 is provided with one or more inclined threads or camming surfaces 9. The lower end of the sealing finish portion is in the form of a circumferential bead 15 having the shoulder 10. The sealing finish portion 14 has a sealing rim 16 at the upper end thereof, said container including a wall 17 defining the container mouth 18. The wall 17 has an inner surface 19 which merges with the sealing rim 16 at an edge 20.

In the structure illustrated, the closure cap top wall 4 has an inner surface 21 which may engage the sealing rim 16 to form the seal. If desired, a suitable gasket 21' may be positioned at the juncture of the top wall and skirt 5 to engage the sealing rim. The skirt 5 depends from the periphery of the top wall 4 and has internal camming surfaces 8 formed thereon for mating engagement with the camming surfaces 9 on the container seating finish portion. While the camming surfaces 8 and 9 may be a plurality of interrupted, inclined portions the structure illustrated shows them as mating threads whereby the closure cap is threaded onto the container to close same. There are a plurality of the detent means 6 flexibly connected to the peripheral skirt 5 by the integral hinges 7 for relative flexing of the detents in radial planes toward and away from the axis that is concentric with and perpendicular to the top wall of the closure 3. In the structure illustrated, both the peripheral skirt 5 and detent means 6 have portions extending below the locking shoulder 10. The skirt has a lower edge 22 and circumferentially spaced slots 23 extending upwardly therefrom with each slot having facing surfaces 24 that are substantially parallel. The detents 6 are located in the respective slots with the hinges 7 connecting the upper ends of the detents with the skirt 5 at the upper end of the slots whereby the detents are movable in radial planes toward and away from the container. The detents have opposed side surfaces 25 that engage the facing surfaces 24 of the slots. The lower portions of the detents have inwardly extending locking lugs 26 positioned to engage under the shoulder 10 when in container closing position.

When the closure is locked on the container the detents and skirt have snap fastener elements or means which in the illustrated structure are interlocking portions to prevent the outward movement of the detents. The interlocking portions are a tongue on one and a recess on the other of the slot surfaces and detent surfaces with mating shoulders to prevent the outward movement of the detents. In the structure illustrated the interlocking portion 11 on the detent is in the form of tongues extending circumferentially outwardly of the opposed side surfaces 25 of the detents, said tongues 27 having outwardly facing surfaces or shoulders 28 terminating in outer edges 29. The tongues 27 have surfaces 30 extending from the outer edges 29 inwardly toward the respective side surface 25 to form inclined portions that facilitate movement of the detents into the locking position as later described. Mating with the tongues 27 are cavities 31 in the facing surfaces 24 on the skirt, said cavities 31 each having abutment surfaces or shoulders 32 that faces inwardly toward the container and are adapted to be engaged by the abutment surfaces 28 of the tongues of the fastener means. It is preferred that each of the tongues have weakened portions 33 provided by reduced thickness adjacent to the side surfaces 25 so that when the detents are forced radially outwardly the tongues will partially tear sufficiently that while the tongues will remain on the detents they will no longer serve as locking members to hold the detents in closure locked position.

The sealing of the closure on the container is also provided by an additional flexible seal member 34 which engages the edge of the container at the sealing rim and inner surface of the mouth. In the structure illustrated there are spaced concentric walls 35 and 36 extending downwardly from the top wall 4 and having their lower ends connected as at 37 to form a generally V-shaped seal member that is integral with the top wall of the closure. It is preferred that at least one of the walls 35 and 36 be thin and positioned to flexibly and resiliently engage the container wall 17 to form a resilient seal engagement between said closure and the container wall 17 adjacent the mouth of the container.

In the structure illustrated the depending skirt 5 has an outer surface portion 38 above the detents formed with longitudinally extending ribs 39 to facilitate rotation of the closure in applying the closure to a container and removing the closure therefrom. Also the skirt 5 is preferably thicker as at 40 on each side of the detents to accommodate the sockets 31 to receive the locking tongues 27.

Figure 3:
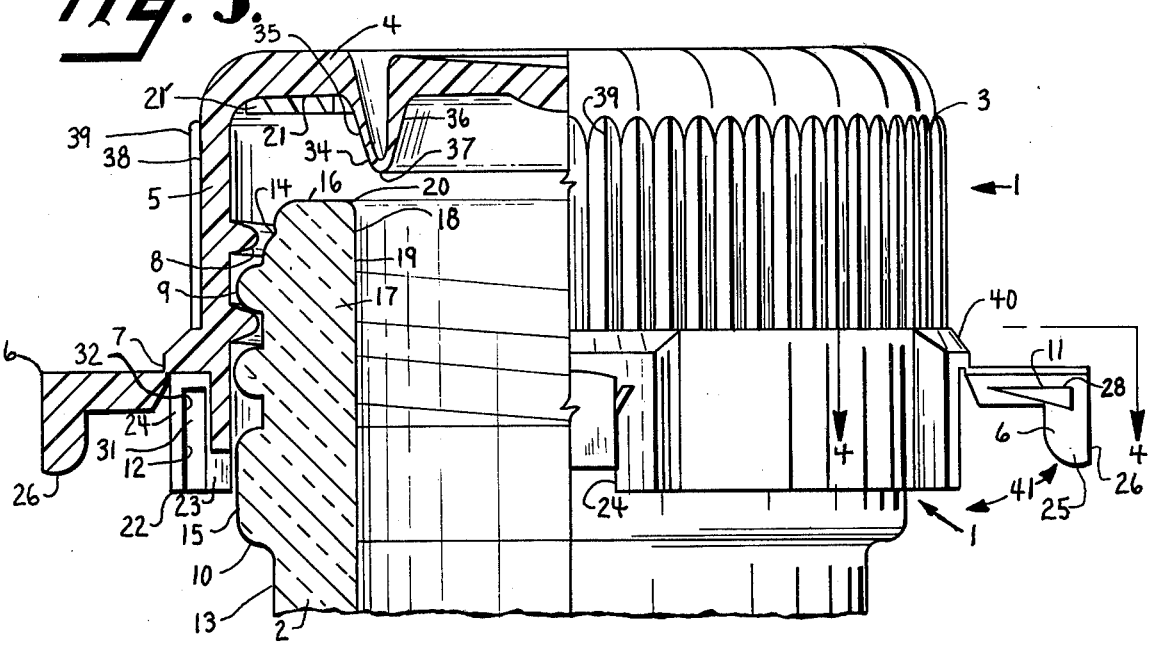
FIG. 3 is a side elevational view, partially in cross-section of the closure cap and container finish showing the locking feature disengaged and the closure cap partially removed from the container finish.
Figure 5:
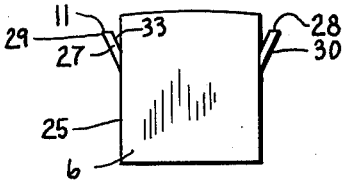
FIG. 5 is an enlarged end view of a free end of a locking lug showing weakened portions of fastening tongues thereon.
Figure 4:
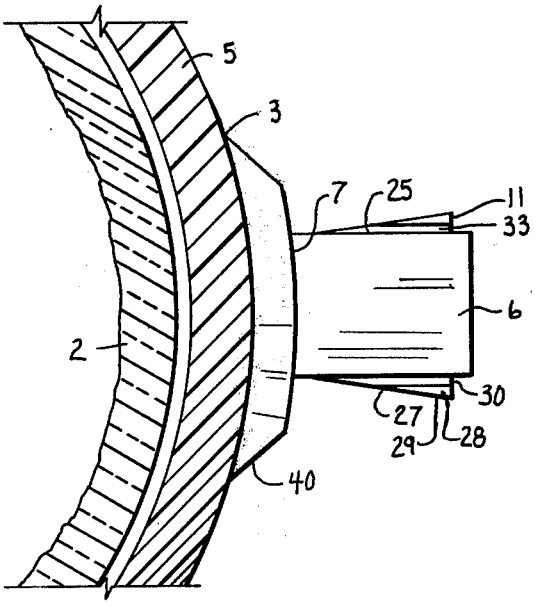
FIG. 4 is an enlarged partial transverse sectional view through the closure cap taken on the line 4—4, FIG. 3 and showing a top view of a locking lug.
Figure 6:
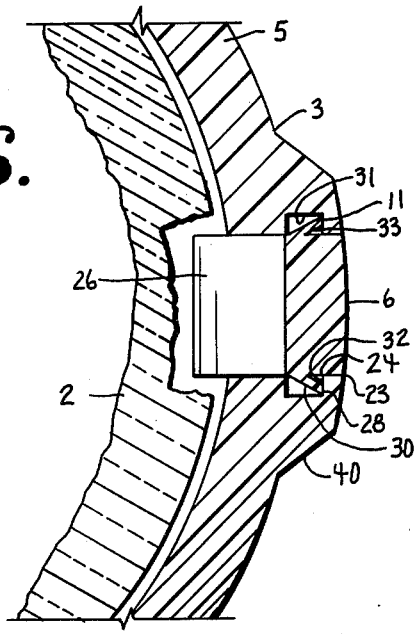
FIG. 6 is an enlarged partial sectional view through the closure cap and locking feature showing a locking tongue engaged in a socket in the closure cap skirt.

The closure illustrated and described is particularly adapted to be molded of a suitable plastic and it is molded with the detents extending radially outwardly as illustrated at 41 in FIG. 3. The detents remain extending outwardly until applied to a container.

In using the container and closure constructed as described, the container is filled with material it is to hold and the closure cap 3 is applied to the sealing finish portion 14 and rotated thereon whereby the mating camming surfaces 8 and 9 on the closure cap 3 and container 2 respectively causes the cap to move downwardly on the container finish until the top wall 4 engages the sealing rim 16 or the seal member 34 engages the container to form the seal. When in that position the detents 6 are then forced to swing downwardly and inwardly with the inward force causing the tongues 27 to be compressed, allowing the detents 6 to move inwardly to position the lugs 26 in engagement under the locking shoulder 10 of the container. When moved sufficiently to the locked position the tongues 27 register with the cavities 31 and expand therein as a snap fastening whereby the abutment surfaces 28 of the tongues 27 engage the abutment surfaces 32 of the cavities. This engagement will retain the detents 6 in the locked position. The removal of the closure is effected by rotating the closure cap 3 in a direction to cause the camming surfaces 8 and 9 to urge the closure cap upwardly on the container 2. The upward movement results in the camming action or application of force between the detents 6 and the shoulder 10 whereby the upwardly movement causes the lugs 26 to be forced outwardly until the tongues 27 are disengaged from the abutment surfaces 32 in the cavities 31. Due to the weakened portions 33 the tongues will be torn sufficiently to prevent their further functioning as fastener means or locking tongues. The release of the tongues 27 allows the detents 6 to swing outwardly and upwardly to an extended position whereby the closure cap 3 can then be further turned and removed from the container 2. All portions of the closure remain connected in a one piece structure, the closure can be reapplied to the container but the detents can no longer be locked and therefore will always extend outwardly sufficiently to be a visual indication that the container has been opened. For disposal the closure can be disposed as a unit, there are no separable pieces and when removed from the container there is no portion of the closure left on the container so that the container can be easily recycled and reused and without special handling as no portion of the closure will remain thereon.

It is to be understood that while I have illustrated and described certain forms of the invention, it is not to be limited to the specific forms or arrangements of parts herein described and shown.

What I claim and desire to secure by Letters Patent is:

1. A tamperproof closure cap for use with a container having an externally threaded neck and a locking shoulder, said closure cap comprising:

(a) a top wall and a peripheral skirt depending from said top wall, said skirt having internal threads formed thereon for mating engagement with the threaded neck of the container;

(b) one or more detent means flexibly connected to said skirt for relative flexing in radial planes toward and away from an axis concentric with and perpendicular to said top wall, said detent means and skirt being integrally connected parts of a unitary cap structure of plastic material; said detent means having circumferentially opposed side edges;

(c) said peripheral skirt and detent means having portions adapted to extend below said locking shoulder with said skirt portions and said detent means having fastener means for interlocking engagement with each other incident to said radial inward movement of said detent means to secure said detent means; and (d) said detent means respectively including inwardly projecting lugs adjacent their lower extremities for holding engagement beneath the said locking shoulder whereby unscrewing of the cap from a container will effect the breaking of the fastener means and outward movement of the detent means.

2. A tamperproof closure cap for use with a container as set forth in claim 1 wherein:

(a) said peripheral skirt portions adapted to extend below said locking shoulder have slots therein with circumferentially opposed faces defining sides of said slots, said flexible connections of the skirt and detent means being at the upper ends of said slots; and (b) said opposed side edges of the detent means and the adjacent sides of the respective slots being disposed for relative movement into substantial endwise abutment when the detent means are flexed radially inwardly toward said axis, said fastener means being on said adjacent sides and edges for said interlocking engagement.

3. A tamperproof closure cap as set forth in claim 2 wherein:

(a) said fastener means on said skirt portions and detent means are circumferentially directed snap fastener elements carried by adjacent sides and edges of said skirt portions and detent means which when interlocked secure the detent means against subsequent radial outward movement; and (b) said snap fastener elements comprise a free ended locking tongue affixed to and projecting circumferentially from one of said sides and edges of the skirt portions and detent means for cooperative locking reception in an oppositely circumferentially directed socket having its mouth opening through the other of said sides and edges.

4. A tamperproof closure cap as set forth in claim 3 wherein:

(a) said circumferentially projecting locking tongues are on opposed side edges of the detent means and the sockets are in opposed sides of the skirt portions defining respective slots.

5. A tamperproof closure cap as set forth in claim 4 wherein:

(a) said sockets have shoulders facing inwardly toward said axis;

(b) said tongues on the detent means have outwardly facing shoulders positioned for engagement with the inwardly facing shoulders in respective sockets; and (c) said shoulders on the tongues are narrow adjacent the flexible connection of the detent means to the skirt and are wider toward the lower extremities of the detent means.

6. A tamperproof closure cap as set forth in claim 4 wherein:

(a) said opposing sides of the slots in the skirt portions are substantially parallel; and (b) said tongues on the opposed side edges of the detent means diverge circumferentially outwardly toward the lower extremities of the detent means.

7. A tamperproof closure cap as set forth in claim 6 wherein:

(a) the closure cap is a one piece structure of molded plastic with the top wall, peripheral skirt, detent means and tongues being integral and the detent means is flexibly connected to the skirt by a thin integral hinge portion which retains the detent means connected to the skirt when swung outwardly thereof on unscrewing of the cap from a container.

8. A tamperproof closure cap as set forth in claim 7 wherein:

(a) the detent means are tabs hinged on the skirt and the tongues on side edges thereof are inclined and compress during radially inward movement to locking engagement with the shoulders in the sockets in the skirt slot sides and said tongues tear upon outward opening movement to provide visual evidence of opening and to be incapable of relocking engagement.

9. A tamperproof package comprising:

(a) a container having a circumferential sealing finish with a sealing rim at the upper end of said circumferential finish;

(b) inclined cam surfaces with a locking shoulder therebelow on said circumferential finish;

(c) a closure cap adapted to be received over said sealing finish; said closure cap comprising:

(1) a top wall of a size to cover said upper end of said sealing finish;

(2) a depending skirt integrally connected to the marginal edge of said top wall;

(3) inclined camming surfaces on said skirt adapted to engage said sealing finish inclined cam surfaces whereby said surfaces urge said cap upwardly when said cap is rotated for removal;

(4) one or more detent means flexibly connected to said skirt for relative flexing in radial planes toward and away from an axis concentric with and perpendicular to said top wall, said detent means and skirt being integrally connected parts of a unitary cap structure of plastic material; said detent means having circumferentially opposed side edges;

(5) said peripheral skirt and detent means having portions adapted to extend below said locking shoulder with said skirt portions and said detent means having fastener means for interlocking engagement with each other incident to said radial inward movement of said detent means to secure said detent means; and (6) said detent means respectively including inwardly projecting lugs adjacent their lower extremities for holding engagement beneath the said locking shoulder whereby rotating the cap for removing same from a container will effect the breaking of the fastener means and outward movement of the detent means.

10. A tamperproof package as set forth in claim 9 wherein:

(a) said container sealing finish includes a wall defining a container mouth with an inner surface joining the sealing rim; and (b) said closure top wall includes an annular projection adapted to extend into the container mouth and sealingly engage said inner surface adjacent said sealing rim.

11. A tamperproof package as set forth in claim 10 wherein:

(a) said annular projection is integral with said top wall and has concentric spaced wall portions connected together in spaced relation to said top wall; and (b) said concentric wall portions being thin and flexible to cooperate with said top wall and sealing rim and provide a resilient seal of the container mouth.

* * * * *